US005636959A

United States Patent [19]

Kroell et al.

[11] Patent Number: 5,636,959

[45] Date of Patent: Jun. 10, 1997

[54] APPARATUS FOR COVERING A SHIP'S HATCH OR OPENING

[75] Inventors: Joachim Kroell, Jüchen; Hermann Franzen, Mönchengladbach; Melanie Gamerschlag, Monheim, all of Germany

[73] Assignee: Mannesmann Aktiengesellschaft, Dusseldorf, Germany

[21] Appl. No.: 577,738

[22] Filed: Dec. 22, 1995

[30] Foreign Application Priority Data

Dec. 22, 1994 [DE] Germany ..... 44 47 386.9

[51] Int. Cl.[6] ..... B63B 19/14

[52] U.S. Cl. ..... 414/137.4; 114/201 R; 414/292

[58] Field of Search ..... 114/201 R; 414/137.4, 414/292

[56] References Cited

U.S. PATENT DOCUMENTS

| | | | |
|---|---|---|---|
| 3,405,814 | 10/1968 | Yanow | 414/137.4 |
| 3,461,891 | 8/1969 | Blomberg | 414/137.4 |

FOREIGN PATENT DOCUMENTS

| | | | |
|---|---|---|---|
| 642179 | 8/1928 | France | 114/201 R |
| 1274460 | 8/1968 | Germany . | |
| 1506737 | 9/1969 | Germany . | |
| 2421902 | 11/1974 | Germany . | |
| 2827415 | 1/1980 | Germany | 114/201 R |
| 4233726 | 10/1993 | Germany . | |
| 4230564 | 2/1994 | Germany . | |
| 270521 | 10/1970 | U.S.S.R. | 114/201 R |
| 379446 | 7/1973 | U.S.S.R. | 114/201 R |
| 437650 | 7/1974 | U.S.S.R. | 414/137.4 |
| 775672 | 5/1957 | United Kingdom . | |

*Primary Examiner*—David A. Bucci
*Assistant Examiner*—Janice L. Krizek
*Attorney, Agent, or Firm*—Cohen, Pontani, Lieberman, Pavane

[57] ABSTRACT

Apparatus for covering a ship's hatch or similar opening that is exposed to weather or environmental conditions, whereby the opening is closable by means of a cover that is at least partially removable. The cover safeguards against water penetration when loading and unloading during bad weather and allows for dry loading and unloading. By sealingly placing a frame-like housing around the edge of the opening, a shaft open on one lateral boundary is formed within the frame housing. The shaft is closable from above by means of overlapping covers, which open automatically when pressed upon by a body suspended on a loading or unloading crane or close automatically when the body is removed.

9 Claims, 3 Drawing Sheets

APPARATUS FOR COVERING A SHIP'S HATCH OR OPENING

BACKGROUND OF THE INVENTION

1. Field of the Invention

The invention relates to an apparatus for a ship's hatch or a similar opening, and more particularly, to a device for covering a ship's hatch or similar opening which is exposed to weather or environmental conditions, whereby the opening can be closed by a cover that is at least partially removable.

2. Description of the Prior Art

Removable covers of this type are known in the art, as disclosed in German Patent Application Number DE-OS 24 21 902. This application discloses a device for moving and folding sectioned hatch covers between decks, and the like. This cover can be brought from a horizontal closed position for cover sections connected in articulated fashion into a folded opened position. Even during partial opening, however, there is still so much open space between the stowage goods and the hatch opening that water is able to penetrate into the ship's hold during bad weather. As a result, loading and unloading ships with pallet loads is often delayed to prevent possible damage to the cargo. This leads to longer wharfage times, resulting in higher wharfage fees.

SUMMARY OF THE INVENTION

It is accordingly an object of the present invention to provide a cover which permits cargo ship loading and unloading, even during rainfall, without allowing large quantities of water to penetrate into the ship's hold, i.e. a dry loading and unloading system.

This object is achieved by placing a frame-like housing in a sealing manner on the edge of a ship's cargo opening, thereby forming a shaft inside the frame-like housing with the shaft being open on one lateral boundary. The shaft is closable from above by overlapping covers, which open automatically when pressed upon by a body suspended on a loading or unloading crane. The overlapping covers are deflected by the crane body in such a way that water hitting them flows to the outside of the frame-like housing away from the ship's opening, and thus cannot penetrate into the ship's hold. After the crane body is removed, the overlapping covers close automatically. In this manner, no water penetrates into the ship's hold during any phase of the transport sequence. The housing can be put into place or removed by the crane itself and therefore can be used for a large number of ship's hatches or similar openings.

A further object of the invention is to provide a frame-like housing with outer surfaces on three lateral boundaries which are inclined outwardly from top to bottom. This results in a stable cover which can be placed over the hatch or opening without further attachment.

An even further object of the invention is to provide a housing part on the open lateral boundary of the shaft which continues the shaft opening. The outer surfaces of the housing part run alongside the opening in an inwardly slanting fashion from above to below. Advantageously, this creates a sealed parallel pathway into the center of the housing for cargo loading and unloading.

A still further object of the invention is to provide overlapping covers including flat elastic self-closing mats. The mats open when pressed upon by the crane body and return to and are held in a closed position by their elasticity upon withdrawal of the crane body.

A yet further object of the invention is to provide a spread gap on the overlapping covers thereby making it easier to open the self-closing mats. This gap is located outside of the base outline of the shaft.

A further object of the invention is to provide the crane body with multiple vertically suspended rollers. These rollers are staggered relative to each other in the run-in and run-out direction. This provides for a reliable spreading of the mats when the crane body is moved against the overlapping covers and also allows the crane cables to move freely within a selected roller configuration.

An even further object of the invention is to provide a crane body designed as a hollow body.

A still further object of the invention is to provide an umbrella-like shield attached to the crane cables above the crane body which keeps out even the last traces of water.

A yet further object of the invention is to provide that the crane body rests outside of the frame-like housing on the load pickup means. This advantageously fixes the position of the crane body at a suitable height relative to the load.

An even further object of the invention is to provide that the crane body rests on the overlapping covers in the loading position after the load pickup device is lowered.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention. An example of the invention is shown in the drawings and described in greater detail below.

BRIEF DESCRIPTION OF THE DRAWINGS

In the drawings in which like numerals are used to denote similar elements.

DETAILED DESCRIPTION OF THE PRESENTLY PREFERRED EMBODIMENTS

Figure 2:
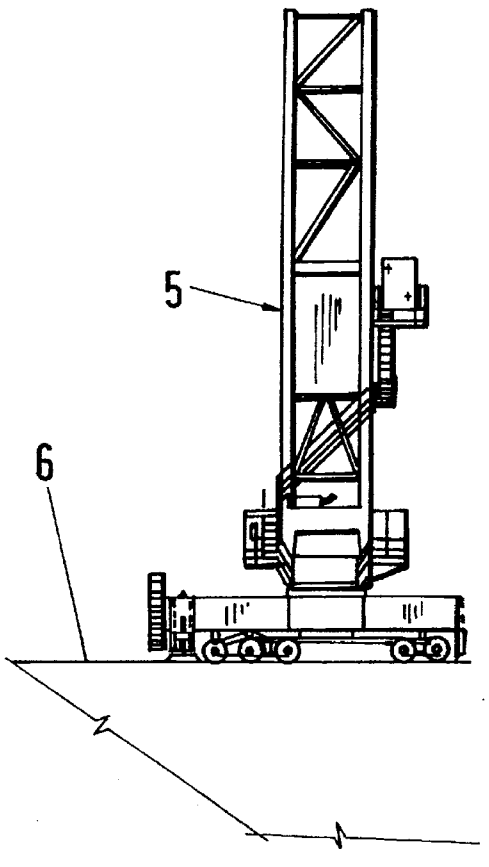
FIG. 2 is an end view of the dockside crane in FIG. 1 with certain parts deleted to more clearly illustrate others.

Referring now to the drawings in detail, a frame-like housing constructed in accordance with the present invention is labelled with the general numeral 3 and is especially useful as a cover for closing a ship's opening exposed to weather or other environmental conditions during cargo loading and unloading.

The apparatus is designed for a ship's hatch or similar opening 1, which is exposed to weather or environmental conditions. The opening 1 can be closed by means of a partially removable cover 2 in the form of the frame-like housing 3. Housing 3 is placed in a sealing relationship at the edge 1*a* of the opening using, for example the load pickup device 4 of a mobile crane 5 to move housing 3 into position. The housing 3 can be removed from a dockside site 6 where it is used to close hatch openings and may be placed in an appropriate storeroom or other remote site for temporary storage.

Figure 1:
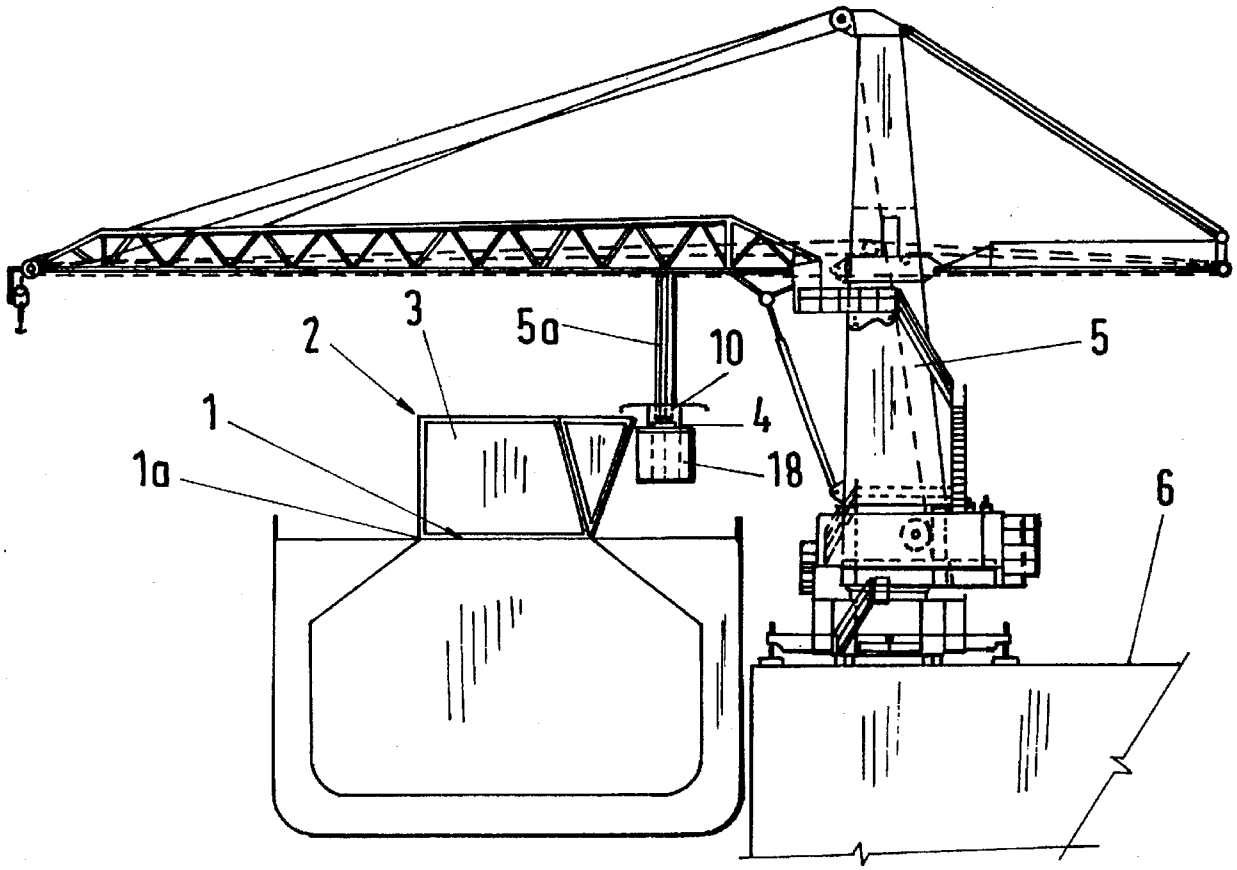
FIG. 1 is a view of a mobile dockside crane with an umbrella-like shield arranged on a load pickup device and a housing placed on a ship's hatch, said ship being diagrammatically shown in cross-section.
Figure 4:
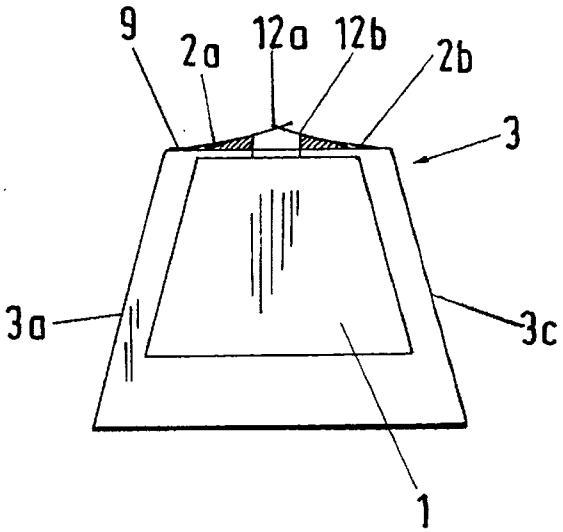
FIG. 4 is the front view of the housing in FIG. 3 looking from the left of FIG. 3.
Figure 3:
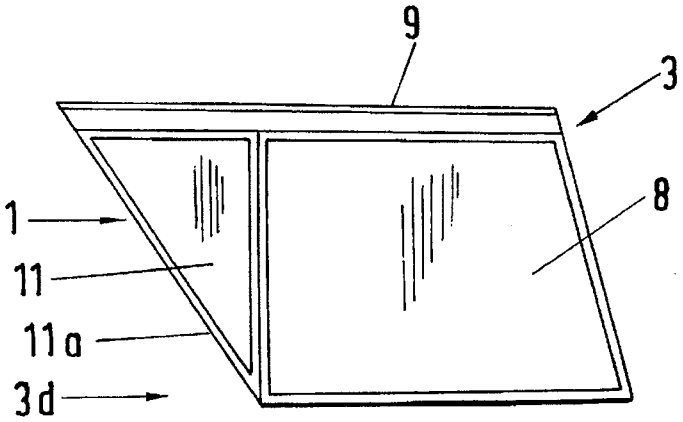
FIG. 3 is a side view of the housing.
Figure 5:
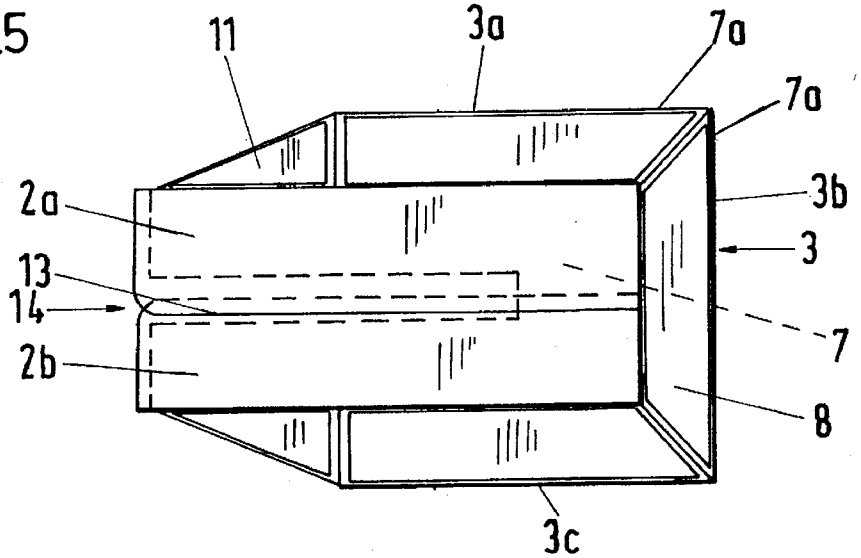
FIG. 5 is a top view of the housing in FIG. 3.

The details of the housing are illustrated in FIGS. 3 to 5. The frame-like housing 3 has four lateral boundaries 3*a*, 3*b*, 3*c* and 3*d*, with a shaft or space 7 open inside the frame-like housing 3 on the lateral boundary 3*d*. From above, the shaft or space 7 corresponds in its shape to the outer surfaces 8 of the frame-like housing 3. These outer surfaces 8 incline outwardly from the top to the bottom of frame 3, thereby defining the three lateral boundaries 3*a*, 3*b*, 3*c*. Preferably outer surfaces 8 are formed of metal sheets. The shaft or space 7 can be closed at the top 9 by overlapping covers 2*a* and 2*b*, which open automatically when pressed upon by a body 10 suspended on the crane 5 or close again automatically upon removal of the body 10 (FIG. 1).

On both sides of the lateral boundary 3*d* of the shaft 7 which is open, there is a housing part 11 that continues the opening 1 and which includes outer surfaces 11*a*. The outer surfaces 11*a* run alongside the opening 1 in an inwardly slanting fashion from above to below.

The overlapping covers 2*a*, 2*b* are preferably produced from flat, elastic mats 12*a* and 12*b* (FIG. 4), which due to their elasticity remain in the normally closed position shown in FIG. 5 if no force acts upon them from outside, e.g. the body 10 suspended on the crane 5 is not present. The shaft 7 is also defined by a base outline 7*a* outside of which the overlapping covers 2*a*, 2*b* form a spread gap 14, which can be formed, for example, by round-offs, as shown in FIG. 5. In another embodiment, the overlapping covers 2*a*, 2*b* may be held in a closed position by, for example springed hinges or other self-closing devices. In yet another embodiment, the overlapping covers 2*a*, 2*b* may be pivotally mounted and held in a closed position by their own weight.

Figure 6:
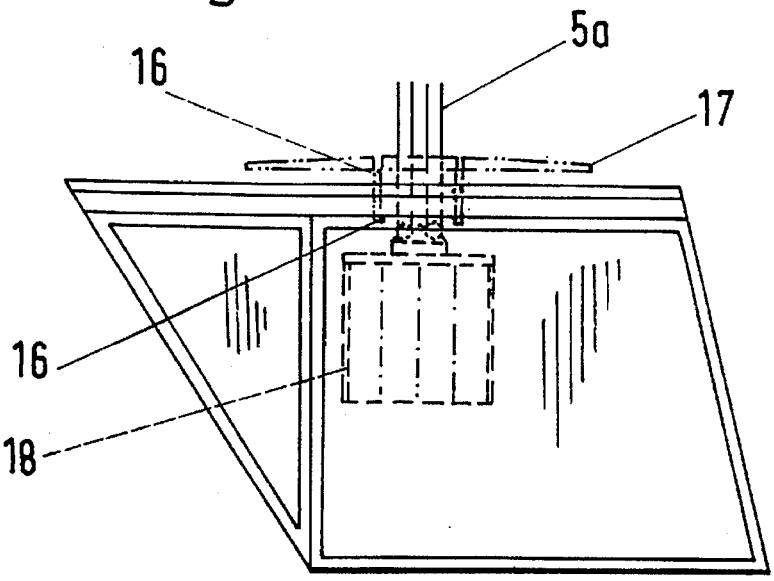
FIG. 6 is a side view of the housing showing the cargo moved into the housing and suspended on the load pickup device with a shield and staggered rollers.
Figure 7:
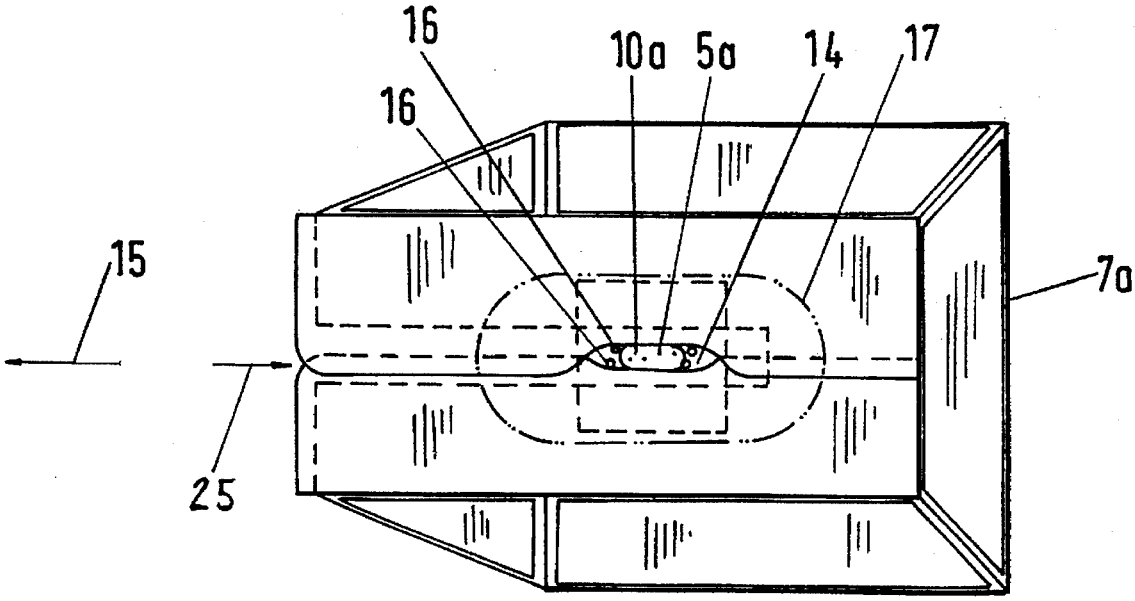
FIG. 7 is a top view of the housing as shown in FIG. 6.

The body 10 suspended on the crane 5 has multiple vertically suspended rollers 16 arranged staggered in the run-in 25 and run-out direction 15. In one embodiment, for example four rollers 16 are used (FIG. 7). This number and position of the rollers 16 permits crane cables 5*a* to move freely. The body 10 suspended on the crane 5 is preferably designed as a hollow body 10*a* and has an oval cross-section. Above the body 10, a canopy-like shield 17 is preferably also attached to the crane cables 5*a* (FIG. 6) to further reduce access of the weather elements to the shaft 7.

In operation, the crane 5 sealingly places the frame-like housing 3 on the edge 1*a* of a ship's hatch or opening 1 (FIG. 1). Cargo 18 may then be moved toward the opening 1 by operating the crane 5 in the run-in 25 and run-out direction 15 through the opening defined as housing part 11. As the cargo is moved in the run-in direction 25, the rollers 16, which are staggered in such a way that first one roller 16 (as shown) rests against the cover 2*a* and somewhat later the adjacent roller 16 rests against the cover 2*b*, spread mats 12*a* and 12*b* apart to the desired spread gap 14 which extends up to the position shown in FIG. 7. In the run-out direction 15, these sequences are reversed, and after the hollow body 10*a* is removed, the covers 2*a* and 2*b* again rest in an overlapping position 13 as in FIG. 5 and close every gap to prevent the penetration of water.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An apparatus for closing a ship's opening during loading and unloading of cargo with a movable crane having cargo supporting cables and a load pickup device, wherein the opening is exposed to weather or other environmental conditions and the opening is closable by means of a partially removable cover, said apparatus comprising:

a housing sealingly placed on an edge of the opening thereby defining a shaft having a base outline and at least one open lateral boundary;

a body suspended on the crane and through which said cargo supporting cables pass, said body having a plurality of vertically suspended rollers being spaced apart in a staggered configuration for allowing said cargo supporting cables to move unrestricted by said rollers within said body when loading and unloading cargo; and a shaft closing means located above said shaft for closing said shaft, said shaft closing means comprising overlapping covers which automatically open when said shaft closing means is pressed upon by said body and which automatically close upon removal of said body from said shaft.

2. The apparatus of claim 1, wherein said overlapping covers further comprise flat elastic mats, the elasticity of said mats biasing said overlapping covers toward a closed position.

3. The apparatus of claim 1, wherein said overlapping covers form a spread gap when pressed upon by said rollers, said spread gap being located outside of said base outline of said shaft.

4. The apparatus of claim 1, wherein said body is hollow.

5. The apparatus of claim 1, further comprising a canopy-like shield, said shield being disposed above said body, said shield being attached to said crane cables.

6. The apparatus of claim 1, wherein said body rests outside of said housing on said load pickup device.

7. The apparatus of claim 1, wherein, during loading, said body rests on said overlapping covers after said load pickup device is lowered.

8. The apparatus of claim 1, wherein said housing further comprises a first lateral boundary having first and second ends, a second lateral boundary having first and second ends and being confrontingly opposite said first lateral boundary, and a third lateral boundary having a first end connected to the first end of said first lateral boundary, and a second end connected to the first end of said second lateral boundary, said lateral boundaries being substantially vertical and having top edges and bottom edges and outer surfaces which incline outwardly from said top edge to said bottom edge.

9. The apparatus of claim 8, wherein said shaft further comprises housing parts, said housing parts each having first ends adjacent the second ends of said first and second lateral boundaries, said housing parts being disposed along the same plane as said first and second lateral boundaries, said housing parts each having an outer surface which runs alongside said open lateral boundary of said shaft, said outer surface slanting outwardly from above to below.

* * * * *